United States Patent [19]

Roberge et al.

[11] 4,335,265

[45] Jun. 15, 1982

[54] ROBOT TAPPING ELECTRODE FOR ELECTRIC ARC FURNACES

[75] Inventors: Serge Roberge, Shawinigan Nord; Jacques Normand, Shawinigan Sud, both of Canada

[73] Assignee: Gulf Canada Limited, Toronto, Canada

[21] Appl. No.: 216,886

[22] Filed: Dec. 16, 1980

[51] Int. Cl.[3] ..... C21B 11/10; C21B 13/12

[52] U.S. Cl. ..... 373/83; 266/271

[58] Field of Search ..... 266/45, 271; 13/33, 13/1

[56] References Cited

U.S. PATENT DOCUMENTS 940,561 11/1909 Seward ..... 13/33

FOREIGN PATENT DOCUMENTS 944390 6/1956 Fed. Rep. of Germany ..... 13/33

*Primary Examiner*—L. Dewayne Rutledge
*Assistant Examiner*—David Hey
*Attorney, Agent, or Firm*—D. R. Morrison

[57] ABSTRACT

An electrode operating device for tapping an electric furnace provides remotely controllable motion of an electrode enabling the electrode to melt a fusible plug in the tap-hole of the furnace of an appropriate diameter to permit draining of material contained in the furnace.

4 Claims, 4 Drawing Figures

ROBOT TAPPING ELECTRODE FOR ELECTRIC ARC FURNACES

FIELD OF THE INVENTION

This invention relates to an electrode operating device for electric furnaces, and more particularly to a remotely controllable tapping electrode, sometimes referred to as a "stinger", which is used to melt a fusible plug in the tap-hole of an electric furnace.

PRIOR ART

It is well known in the operation of electric smelting furnaces, for example furnaces for production of calcium carbide or of ferrosilicon, to remove the molten charge from the furnace by draining it through a tap-hole in the side of the furnace, near the bottom thereof. During the smelting operation the molten charge in the furnace is prevented from draining out through the tap-hole by a plug of solid material, e.g. furnace charge or slag, which can be fused or melted then drained from the tap-hole by the heat of an arc from a tapping electrode. When it is desired to drain molten charge from the furnace, the tapping electrode or "stinger", which usually is a carbon electrode at the electrical potential of a furnace electrode remote from the tap-hole, is manipulated into position in proximity to the plug in the tap-hole. The arc which discharges from the tapping electrode through the tap-hole plug and molten charge to the furnace electrode nearest the tap-hole starts to fuse a portion of the plug, and as the electrode is manipulated in close proximity to the plug, the plug gradually fuses and melts away, leaving the tap-hole open and permitting draining of the furnace. When tapping is completed, the tap-hole is gain plugged with a quantity of appropriate solid, granular but fusible material which is rammed into the tap-hole.

Because of the extremely high temperature of the material being drained from the furnace (generally in the range 1000° to 2000° C.), the arc created by the tapping electrode to melt the plug must be made while any human operator remains at considerable distance from the plug. This has generally been achieved by having a long pole suspended at about mid-point from overhead with the electrode attached to one end thereof and one or more operators manually controlling the other end to position and move the electrode across and around the plug to create the arc which does the required melting. However, this is a cumbersome, awkward, and frequently dangerous operation which can be obviated by means of the present invention.

SUMMARY OF THE INVENTION

The invention consists in an apparatus for controlling movement of a tapping electrode to tap the molten charge from an electric furnace, comprising:

(a) a rotatable drive means, adapted to be moved in both directions along its axis of rotation, (b) a means to control the position of said rotatable drive means along its axis of rotation, (c) a rotatable shaft retained in a non-rotating bearing member at a point in its length between its ends in such manner (i) that said rotatable shaft can rotate about its longitudinal axis and said longitudinal axis can pivot at said bearing member to any position in a cone coaxial with the axis of rotation of said rotatable drive means, the cone tip angle being no greater than substantially 45°, and (ii) that said rotatable shaft cannot move along its own axis through the bearing member, said rotatable shaft being adapted to engage said rotatable drive means in such manner that the amount of displacement of the axis of said rotatable shaft is controlled by the distance of said rotatable drive means from said non-rotating bearing member, (d) a supporting shaft pivotally supported between its ends and attached to said rotatable shaft by a coupling means permitting both rotation of said rotatable shaft and angular displacement of the two shafts relative to each other, and (e) an elongated electrode fixed to said supporting shaft near its end opposite to the end at which said rotatable shaft is coupled.

BRIEF DESCRIPTION OF THE DRAWINGS

The invention may be understood more readily from an illustration of a preferred embodiment thereof given in the accompanying drawings.

DETAILED DESCRIPTION OF THE PREFERRED EMBODIMENT

Figure 1:
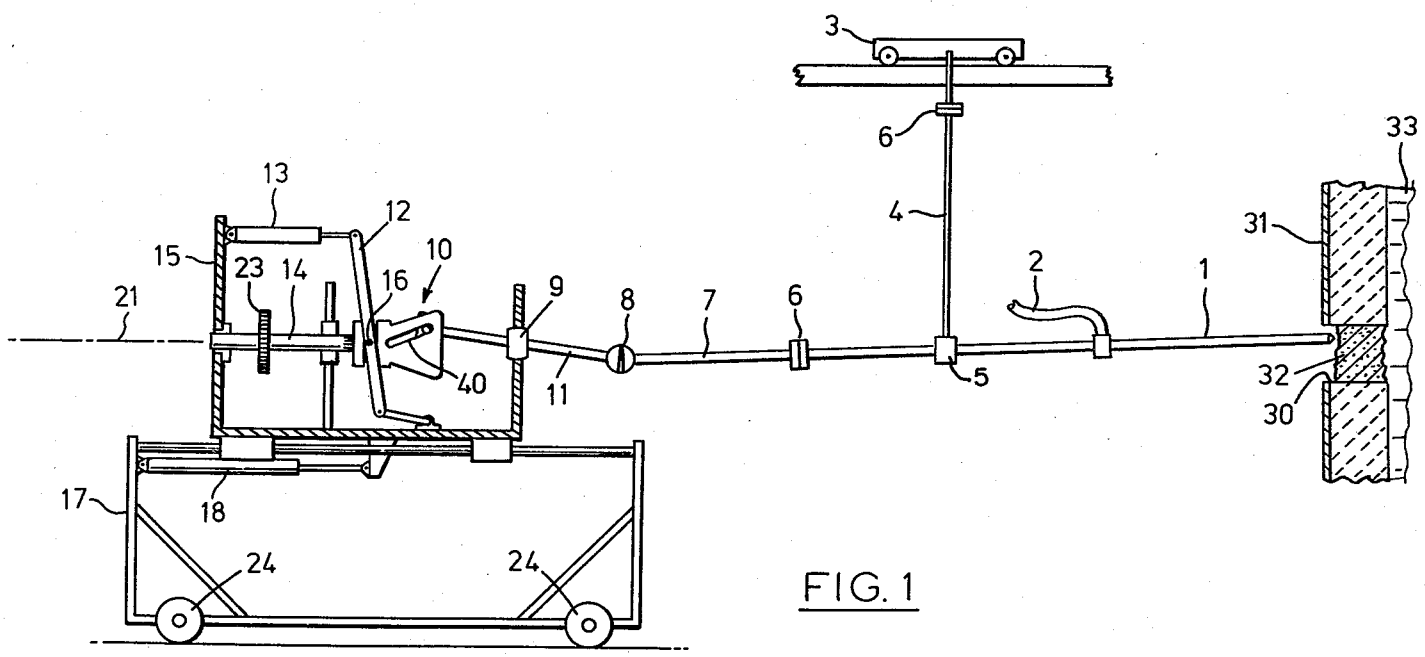
FIG. 1 illustrates a remotely controlled powered tapping device positioned to act upon a solid plug of fusible material in the tap-hole of an electric furnace, in accordance with a preferred embodiment of the invention.

Referring to FIG. 1, tapping electrode 1 is positioned adjacent to and in line with a tap-hole 30 in an electric furnace 31. By means of electric current supplied through flexible electrical connection 2, tapping electrode 1 can cause solid reaction mass 32 to fuse in the arc created when the tapping electrode is close to it, thereby creating a hole through which liquid reaction mass 33 can pass, allowing furnace 31 to discharge. A relatively large diameter hole in solid reation mass 32 compared to the diameter of tapping electrode 1 is created by moving the top of tapping electrode 1 in a circular motion of variable diameter which combines with forward motion at a controlled rate to advance the tapping electrode 1 at about the same rate as the solid reaction mass fuses. The circular and forward motions are induced through shafts 7 and 11, the former serving primarily as an elongated electrode holder and the latter being coupled thereto by an appropriately flexible coupling 8. Shaft 11 is so mounted in bearing 9 that shaft 11 can be rotated axially and simultaneously deflected from a coaxial alignment with rotational axis 21, but cannot move longitudinally through bearing 9. Bearing 9 is rigidly mounted in thrust carriage 15 which in turn is slidably mounted on trolley 17 and equipped with a remotely controlled cylinder 18 to impart remotely controlled forward and reverse motion to thrust carriage 15 and hence through bearing 9 and shafts 11 and 7 to tapping electrode 1. Rough vertical alignment of rotational axis 21 with tap-hole 30 is achieved by vertical adjustment of the position of thrust carriage 15 on trolley 17, for example, or by other suitable means. Vertical placement of tapping electrode 1 is established by fulcrum 5 which is suspended, for example by electrically insulated chain or cable 4, from suspension carriage 3. Suspension carriage 3 is equipped with means, for example wheels operating on a track, to allow it to move towards and away from tapping hole 30 as thrust carriage 15 is advanced and withdrawn. Because tapping electrode 1 carries a heavy current at a raised electrical potential, insulators 6 are fitted between it and shaft 7 and other supporting parts in order to prevent short circuits. Non-rotating support shaft 7 is operated by rotating shaft 11 through coupling 8 that allows rotational motion of shaft 11 and axial deflection thereof relative to shaft 7; most conveniently the coupling 8 is of the ball and socket joint type. Shaft 11 is rotated by sliding member 10, which in turn is slidably mounted on and rotated by drive shaft 14, which shaft is coaxial with rotational axis 21. As sliding member 10 is advanced towards bearing 9, pin 20, engaged in slot 40, is brought closer to a coaxial position with respect to rotational axis 21 and at the limit of advance the axial deflection of shaft 11 becomes zero. Conversely as sliding member 10 is drawn back from bearing 9, pin 20 is deflected from axial alignment with shaft 14, thereby deflecting coupling 8 and in turn the tip of tapping electrode 1 from the rotational axis. Means to advance or withdraw sliding member 10 is provided by jointed bar assembly 12 actuated by remotely controlled cylinder 13. Shaft 14 is rotated through sprocket 23 by a motor and drive system (not shown) providing a convenient speed of about 15 to 32 revolutions per minute. Remotely controlled cylinders 18 and 13 can be, for example, hydraulic or pneumatic cylinders. Trolley 17 is fitted with wheels 24, with the latter preferably running on light rails to facilitate maintenance of alignment of the device with a tapping hole when it is advanced toward or withdrawn from the tapping hole. Optionally for convenience, the wheels 24 can be power-driven.

Figure 2:
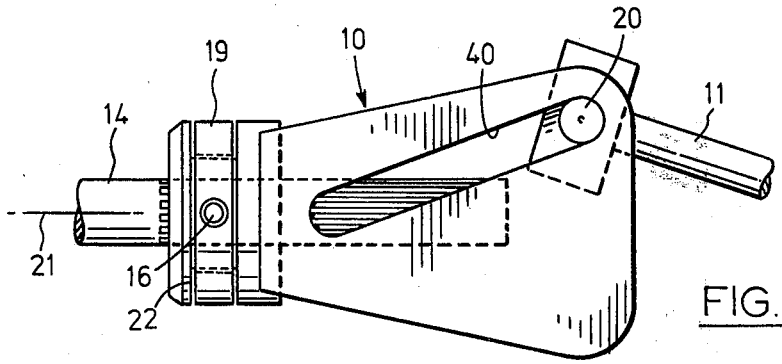
FIG. 2 is a close-up view of that part of the device shown in FIG. 1 which imparts a controllable offset rotating motion which is transmitted to a tapping electrode in said preferred embodiment.

In FIG. 2, the enlarged view of sliding member 10 illustrates the arrangement of a collar 19 which is coupled flexibly to bar assembly 12 (shown in FIG. 1) by means of two pins 16 protruding through two holes in bar assembly 12, one on each side of collar 19. The collar fits into groove 22 near the end of sliding member 10, and slides sliding member 10 on shaft 14 as bar assembly 12 is advanced or withdrawn.

Figure 3:
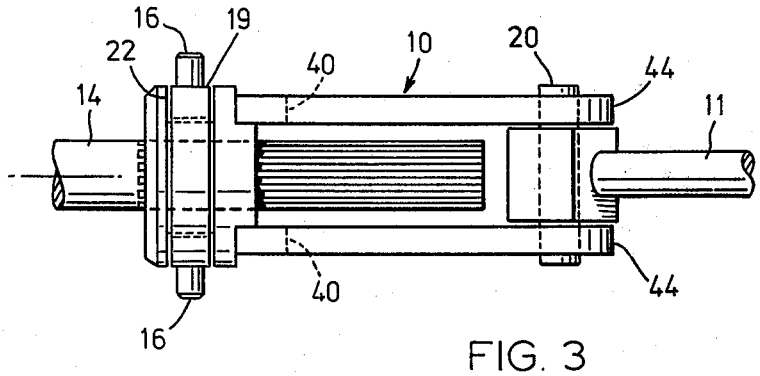
FIG. 3 is a close-up view as in FIG. 2, but taken at right angles to the view of FIG. 2.

FIG. 3 shows sliding member 10 in a view taken at right angles to that of FIG. 2. Plates 44 on each side of rotating shaft 11 rotate said shaft in step with the rotation of sliding member 10.

Figure 4:
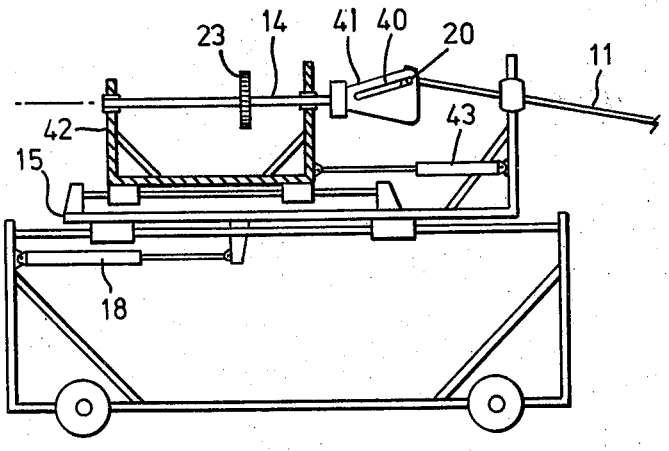
FIG. 4 illustrates an alternative embodiment of the remotely controlled powered tapping device, incorporating an alternative means of imparting the controllable offset rotating motion which is transmitted to the tapping electrode.

In FIG. 4 an alternative means of controlling the amount of deflection of shaft 11 is shown. Rotating drive member 41 is rigidly attached to shaft 14. Rotating drive member 41, shaft 14 and sprocket 23 are supported by radial deflection carriage 42, which is provided with adjustment means 43, for example a remotely controlled cylinder, which governs the position of slot 40 relative to pin 20 and thus controllably displaces pin 20 and thereby shaft 11 from axial alignment with shaft 14. Through coupling 8 and shaft 7 shown in FIG. 1, the tip of tapping electrode 1 is thereby caused to describe a circular motion and to tap an appropriately sized hole in solid reaction mass 32, as it is advanced into the hole through the action of remotely controlled cylinder 18 on thrust carriage 15.

The invention is not restricted to the specific embodiments shown in FIGS. 1 to 4 and described above. For example, the movement of the carriages in FIGS. 1 and 4 and of bar assembly 12 in FIG. 1 is shown to be effected by remotely controlled cylinders 13, 18 and 43. However, controlled movement can be effected by other means, for example a reversible motor driving a threaded screw. Although the drive shaft, sliding drive member and rotatable shaft are shown mounted on a thrust carriage which is in turn slidably mounted on a trolley so that the electrode can be advanced towards the tapping hole as the solid material plugging the tapping hole gradually fuses, they can alternatively be mounted directly on a trolley with the entire trolley being advanced to move the electrode into position.

Although the sliding member 10 is shown with parallel slots, it is within the scope of the invention to employ a pin fixed between the two parallel flat plates whose longitudinal axis passes through the axis of rotation 21, said pin engaging an angled slot in a flat member fastened to the rotatable shaft 11. Similarly, the sliding member 10 can be fitted with one plate and the end of rotatable shaft 11 can be fitted with two arms, one being positioned on each side of said plate. The pin can be fixed either to the sliding member, engaging the angled slot in the rotatable shaft, or to the rotatable shaft engaging the angled slot in the sliding member. The angle of the slot can be from about 20° to about 60°; the slot position can be reversed so that the rotating shaft 11 deflects away from a coaxial position as sliding member 10 is advanced. All of the embodiments described in this paragraph produce the same controllable offset as the preferred embodiment shown in the drawings.

The lengths of shafts 7 and 11 and the position on them of pivot point 5 and bearing 9 respectively are chosen for convenience in carrying out the tapping procedure. Because the reaction mass 33 is typically at very high temperatures, the combined length of tapping electrode 1 and shaft 7 is great enough to prevent overheating of any elements carried on trolley 17. The maximum diameter of the tap-hole created in reaction mass 32 is approximately proportional to $$\sin A\,(b/a)(d/c)$$

where A is the maximum angular deflection of shaft 11 from rotational axis 21, a is the length of shaft 11 from pin 20 to bearing 9, b is the length of shaft 11 from bearing 9 to coupling 8, c is the length of shaft 7 from coupling 8 to fulcrum 5, and d is the combined length of shaft 7 and tapping electrode 1 from fulcrum 5 to the tip of tapping electrode 1

As the tapping procedure is carried out over an extended period of time, electrode 1 becomes shorter and the maximum available diameter of tap-hole that can be made also becomes smaller. Dimensions A, a, b, c and d are designed so that a satisfactory tap-hole can be made with all practical lengths of tapping electrode 1. Provision can be made additionally or alternatively, to adjust the length of tapping electrode 1, for example by a remotely controlled cylinder acting on the attachment point of said electrode. Electrode 1 can be provided with threaded end fittings to accept additional lengths of electrode material, as is known in the art.

Other embodiments can be envisaged by a person skilled in the art without departing from the scope of the invention.

What is claimed is:

1. An apparatus for controlling movement of a tapping electrode to tap the molten charge from an electric furnace, comprising:

(a) a rotatable drive means, adapted to be moved in both directions along its axis of rotation, (b) a means to control the position of said rotatable drive means along its axis of rotation, (c) a rotatable shaft retained in a non-rotating bearing member at a point in its length between its ends in such manner (i) that said rotatable shaft can rotate about its longitudinal axis and said longitudinal axis can pivot at said bearing member to any position in a cone coaxial with the axis of rotation of said rotatable drive means, the cone tip angle being no greater than substantially 45°, and (ii) that said rotatable shaft cannot move along its own axis through the bearing member, said rotatable shaft being adapted to engage said rotatable drive means in such manner that the amount of displacement of the axis of said rotatable shaft is controlled by the distance of said rotatable drive means from said non-rotating bearing member, (d) a supporting shaft pivotally supported between its ends and attached to said rotatable shaft by a coupling means permitting both rotation of said rotatable shaft and angular displacement of the two shafts relative to each other, and (e) an elongated electrode fixed to said supporting shaft near its end opposite to the end at which said rotatable shaft is coupled.

2. In an apparatus for tapping liquid material from a vessel, comprising an elongated electrode, a shaft supporting said electrode and a support means supporting said shaft and electrode, the improvement comprising:

(a) a rotatable drive means, adapted to be moved in both directions along its axis of rotation, (b) a means to control the position of said rotatable drive means along its axis of rotation, and (c) a rotatable shaft retained in a non-rotating bearing member at a point in its length between its ends in such manner (i) that said rotatable shaft can rotate about its longitudinal axis and said longitudinal axis can pivot at said bearing member to any position in a cone coaxial with the axis of rotation of said rotatable drive means, the cone tip angle being no greater than substantially 45°, and (ii) that said shaft cannot move along its own axis through the bearing member, the rotatable shaft being adapted at one end to engage said rotatable drive means in such manner that the amount of displacement of the axis of said rotatable shaft is controlled by the distance of said rotatable drive means from to said non-rotating bearing member, and adapted at the other end to engage the supporting shaft in such manner that angular displacement of said rotating shaft causes angular displacement of said supporting shaft without rotating said supporting shaft.

3. An apparatus as claimed in claim 1, where said rotatable drive means comprises:

(a) a drive shaft, and (b) a sliding drive member slidably mounted on and rotated by said drive shaft.

4. An apparatus as claimed in claim 1, where said rotatable drive means comprises:

(a) a drive shaft, (b) a rotating drive member rigidly mounted on and rotated by said drive shaft, and (c) a drive support means supporting said drive shaft and said rotating drive member, adapted to be moved in both directions along the axis of rotation of said rotating drive member.

* * * * *